United States Patent [19]

Harris

[11] 4,330,912

[45] May 25, 1982

[54] FURNACE ROLL

[75] Inventor: Velvin E. Harris, Carrollton, Ga.

[73] Assignee: Crucible Inc., Pittsburgh, Pa.

[21] Appl. No.: 160,414

[22] Filed: Jun. 18, 1980

[51] Int. Cl.[3] ..... B21B 13/02

[52] U.S. Cl. ..... 29/130; 165/89; 266/261

[58] Field of Search ..... 29/130, 132, 122, 115, 29/110; 165/89; 148/135; 266/261

[56] References Cited

U.S. PATENT DOCUMENTS

| | | | |
|---|---|---|---|
| 3,815,881 | 6/1974 | McCann | 266/261 |
| 4,074,750 | 2/1978 | Beghin | 29/110 X |
| 4,086,957 | 5/1978 | Schrewe et al. | 165/89 |

*Primary Examiner*—Peter P. Nerbun

*Attorney, Agent, or Firm*—Clair X. Mullen, Jr.

[57] ABSTRACT

A roll especially adapted for supporting alloy pipe and tubing during travel through an annealing furnace; the roll has a roll body constructed of at least one refractory casting mounted on a cooled shaft and having a reinforcing binder distributed substantially evenly throughout the refractory and a metal surface portion in surface contact with the pipe or tubing; there is no metal-to-metal contact between the cooled shaft and the metal surface portion of the roll body so that said surface portion is maintained at substantially the same temperature as the annealing furnace.

12 Claims, 3 Drawing Figures

FURNACE ROLL

In the manufacture of alloy tubing and specifically welded alloy tubing of stainless steel, it is customary practice to form from a continuous strip or band of stainless steel a tubular form by a roll-forming operation. During this roll-forming operation the edges of the strip are progressively bent until they touch to form a longitudinal seam. This seam is then joined by a longitudinal welding operation. The metal of the tubing affected by this welding operation takes on an undesirable cast structure, which structure does not exhibit the desired properties such as good corrosion resistance. It is, therefore, typical in the manufacture of welded, stainless steel tubing to subject the tubing after welding to an annealing treatment wherein the tubing is heated for a time at temperature sufficient to achieve recrystallization of the metal. Typically this annealing treatment is performed in a continuous furnace provided with heat-resistant, spaced-apart drive rolls on which the tubes are supported and carried through the furnace at a predetermined rate depending upon the tube section, annealing temperature desired, time at temperature and the like. After annealing, scale is removed by an acid pickling operation which may be followed by straightening, cutting, inspection and testing.

It is customary practice to construct the furnace rolls from a cast alloy, so that the roll body constitutes a casting mounted on a water-cooled shaft. It has been found, however, that rolls made of cast alloy, particularly when used to support welded stainless steel tubing within an annealing furnace, adversely affect the surface quality of the tubing being carried through the furnace by the rolls. This results because the surface of the roll body in contact with the tubing is cooled by conduction from the coolant circulated through the roll shaft. Hence, the roll body surface contacting the tubing is at a temperature lower than the tubing and the furnace temperature. This causes marring of the tubing surface by "pick-up" from the roll surface. In addition, the cooling effect on the portions of the tubing surface contacting the roll surface causes these affected areas to be improperly annealed and thus the structure of the tubing is not uniform.

Furthermore, with cast rolls the temperature differential within the roll body between the area adjacent the cooled roll shaft and the surface area of the roll causes cracking of the roll body.

It is accordingly a primary object of the present invention to provide a furnace roll particularly adapted for use in supporting alloy tubing during travel through an annealing furnace, and particularly welded stanless steel tubing, which furnace roll is not characterized by the aforementioned disadvantages associated with furnace rolls having conventional cast alloy bodies.

A more specific object of the invention is to provide a furnace roll having a cooled shaft and a surface portion in contact with the pipe or tubing traveling through the furnace, which surface portion is at substantially the same temperature as the furnace and the pipe or tubing.

This and other objects of the invention as well as a more complete understanding thereof may be obtained from the following description, examples and drawings in which.

Broadly in the practice of the invention the furnace roll includes a shaft, which is typically water cooled, and on which is rigidly and concentrically mounted a roll body. The roll body may be of various configurations but one configuration in accordance with the invention that is especially adapted for supporting pipe or tubing during travel through an annealing furnace comprises two opposed frustums tapered toward and separated by a grooved portion. The roll body is constructed from refractory material, which material should have a compressive strength sufficient to support the weight of the tubing at the temperatures prevailing in the furnace, and each frustum has its tapered surface portions covered with a high temperature strength and oxidation resistant alloy.

Preferably the refractory has alloy particles, which in the preferred embodiment of the invention are a high temperature strength and oxidation resistant alloy such as a stainless steel in needle-like form, dispersed therein as a reinforcing binder. The dispersion of alloy prticles should be relatively uniform throughout the refractory, and should be of an alloy that will maintain its integrity at the prevailing temperatures, such as AISI Type 310 stainless steel. The high temperature strength and oxidation resistant alloy which covers the tapered surface portions of the roll body to achieve its desired function in combination with the refractory of the roll body should be able to withstand the prevailing furnace temperatures. In the case of annealing furnaces used in the annealing of welded stainless steel tubing, the furnace temperatures are on the order of 1950°to 200° F.

Figure 1:
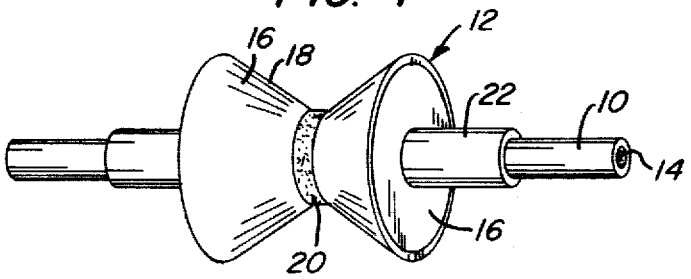
FIG. 1 is a perspective view of a furnace roll in accordance with the present invention.
Figure 2:
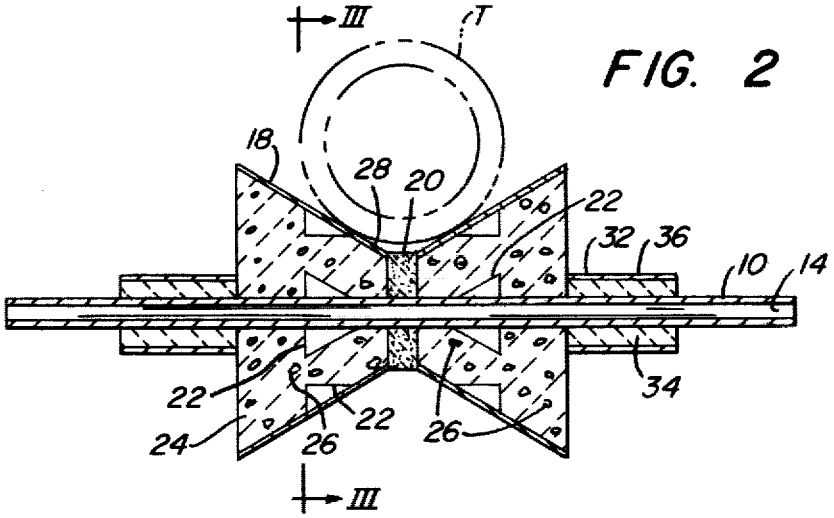
FIG. 2 is a view of the furnace roll in accordance with the invention in vertical cross-section.
Figure 3:
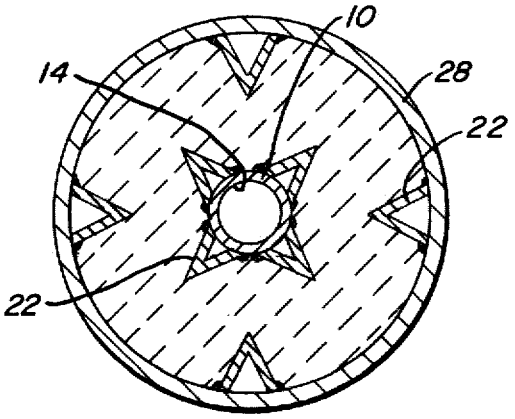
FIG. 3 is a vertical section taken along lines III—III of FIG. 2.

With respect to the drawing, and for the present to FIG. 1 thereof, there is shown a furnace roll in accordance with the invention having a shaft 10 and a roll body 12 rigidly and concentrically mounted thereon. Tubing, designated in phantom in FIG. 2 as T, is carried on the roll body. The shaft 10 has a concentric through passage 14 to permit the circulation of coolant such as water. The roll body comprises two opposed frustums each identified as 16 having tapered surfaces 18 converging to define a grooved refractory portion 20. As may be seen in FIG. 2 each frustum 16 is constructed of a refractory casting 24 having stainless steel particles 26 dispersed substantially evenly throughout. The tapered surfaces 18 of each frustum are covered with a high temperature strength and oxidation resistant alloy in the form of a plate material and designated as 28 in FIG. 2. The roll body 12 is rigidly connected to the shaft 10 by a plurality of lugs 22, as best shown in FIGS. 2 and 3. These lugs are secured, as by welding, to the shaft 10 and the plates 28 of the roll body. The lugs 22 as best shown in FIG. 3 are constructed from angled metal plates of a material capable of withstanding the high furnace temperatures, such as high temperature strength and oxidation resistant stainless steel. During construction of each frustum of the roll body, the refractory is poured into the cavity formed by the plates 28 with the shaft 10 in place. The lugs 22, upon solidification of the refractory secure it to the shaft and within the cavity defined by plates 28. It is to be understood that the lugs 22 for purposes of clarity of illustration are shown in FIGS. 1 and 2 larger than scale; in addition, more lugs would be used in actual practice than shown in the drawings and specifically a series of lugs would be provided along the length of the shaft 10 within the confines of the roll body to permit transfer of torque from the shaft to the roll body. There is no through-metal contact from the shaft 10 to the plates 28 of the roll body. This prevents cooling of these plates from the coolant circulated through the shaft, so that the plates remain at a temperature substantially the same as the furnace temperature at the location of the roll within the furnace. The grooved portion 20 of the roll body likewise constitutes a refractory casting; this refractory material may be identical to that constituting the casting of the frustums.

During use of the roll in an annealing furnace the tubing T as it travels through the furnace is supported on the tapered surfaces 18 of the roll body and out of contact with the grooved portion 20, as shown in FIG. 2. It is important that the tubing remain out of direct surface-to-surface contact with the refractory of the roll body, because contact with the refractory would result in marring of the tubing surface. Sleeves 32 are also made from a refractory casting 34 which may be identical to that of the roll body, and are covered with alloy in the form of plate material designated as 36, which may be similar to that of the roll body. The function of sleeves 32 is to protect and insulate the shaft 10 from the high furnace temperatures.

Although various high temperature strength and oxidation resistant alloys may be used in the construction of the roll body one preferred example of an alloy is a nickel-base alloy consisting essentially of, in weight percent, about 22 chromium, 18 iron, 9 molybdenum, up to 2.5 cobalt, up to 1 tungsten, up to 1 manganese, up to 1 silicon, 0.05 to 0.15 carbon, and the remainder nickel.

A second more preferred alloy for use in construction of the roll body is a stainless steel consisting essentially of, in weight percent, 0.2 max. carbon, 34 to 37 nickel, 14.5 to 16.5 chromium, 2 max. manganese, 0.75 to 1.5 silicon, 0.04 max. sulfur, 0.04 max. phosphorus and balance iron.

One example of a commercially available high compressive strength castable refractory suitable for use in constructing the roll body in accordance with the invention is PLICAST 3000 castable refractory commercially available from Plibrico Company of Chicago, Illinois. This castable refractory has a nominal composition of 49.9% alumina, 44.33% silica, 3.01% CaO, 1.1% $Fe_2O_3$, 1.18% $TiO_2$, 0.13% MgO and balance alkalines. Broadly castable refractories meeting ASTM Specification C-401, Class E would be suitable for the purpose.

I claim:

1. A furnace roll especially adapted for supporting pipe or tubing during travel through an annealing furnace, said roll comprising a shaft having a refractory roll body concentrically mounted thereon, said roll body having a metal surface portion in surface contact with said pipe or tubing and means for maintaining said shaft at a temperature cooler than the temperature of said annealing furnace, said metal surface portion and said roll shaft having no metal-to-metal contact therebetween and a reinforcing binder substantially evenly distributed throughout the refractory roll body, said binder being of a material that will maintain its integrity at the temperatures prevailing within said furnace.

2. The roll of claim 1 wherein said reinforcing binder is metal particles.

3. The roll of claim 2 wherein said metal particles are a high temperature and oxidation-resistant alloy.

4. The roll of claim 3 wherein said high-temperature and oxidation-resistant alloy is stainless steel.

5. The roll of claim 1 wherein said metal surface portion of said roll body is at substantially the same temperature as ambient furnace temperature.

6. The roll of claim 5 wherein said metal surface portion of said roll body is a high-temperature and oxidation-resistant alloy.

7. A roll especially adapted for supporting pipe and tubing during travel through an annealing furnace, said roll comprising a shaft through which a coolant is circulated and on which is rigidly and concentrically mounted a roll body, said roll body comprising two opposed frustums tapered toward and separated by a groove portion, said roll body being constructed from refractory material having a reinforcing binder substantially evenly distributed throughout, said binder being of a material that will maintain its integrity at the temperatures prevailing within said furnace, and each frustum having tapered surface portions covered with a high-temperature strength and oxidation-resistant alloy on which said pipe or tubing is supported with no metal-to-metal contact between said surface portion and said shaft.

8. The roll of claim 7 wherein said reinforcing binder is in the form of a dispersion of alloy particles in needle-like form.

9. The roll of claim 8 wherein said high-temperature strength and oxidation-resistant alloy constituting said tapered surface portions is capable of withstanding furnace temperatures of about 2000° F. without significant oxidation and exhibiting strength sufficient to support said pipe or tubing.

10. The roll of claim 9 wherein each frustum is constructed from a refractory casting.

11. The roll of claim 7 wherein said high-temperature strength and oxidation-resistant alloy constituting said tapered surface portions consists essentially of, in weight percent, about 22 chromium, 18 iron, 9 molybdenum, up to 2.5 cobalt, up to 1 tungsten, up to 1 manganese, up to 1 silicon, 0.05 to 0.15 carbon and balance nickel.

12. The roll of claim 7 wherein said high-temperature strength and oxidation-resistant alloy constituting said tapered surface portions consists essentially of, in weight percent, 0.2 max. carbon, 34 to 37 nickel, 14.5 to 16.5 chromium, 2 max. manganese, 0.75 to 1.5 silicon, 0.04 max. sulfur, 0.04 max. phosphorus and balance iron.

* * * * *